US006145603A

United States Patent [19]

Weaver et al.

[11] Patent Number: 6,145,603

[45] Date of Patent: Nov. 14, 2000

[54] EXTENSION DRILLING SYSTEM

[75] Inventors: Steven Weaver, Maryland; Michael McLean, Lambton, both of Australia

[73] Assignee: Sandvik AB, Sandviken, Sweden

[21] Appl. No.: 09/095,502

[22] Filed: Jun. 11, 1998

[30] Foreign Application Priority Data

Jun. 11, 1997 [AU] Australia ..... PO7260

[51] Int. Cl.[7] ..... E21B 17/00

[52] U.S. Cl. ..... 175/235; 175/320

[58] Field of Search ..... 175/203, 235, 175/318, 320, 415, 416, 417, 418

[56] References Cited

U.S. PATENT DOCUMENTS

| | | | |
|---|---|---|---|
| 2,662,603 | 12/1953 | Jones | 175/318 |
| 3,096,825 | 7/1963 | Clark, Jr. | 175/235 |
| 3,166,132 | 1/1965 | Lenahan et al. | 175/235 |
| 4,702,328 | 10/1987 | McSweeney et al. | 175/320 |
| 4,773,490 | 9/1988 | McSweeney et al. | 175/320 |
| 4,834,594 | 5/1989 | Morgan | 175/320 |
| 4,907,660 | 3/1990 | Staggs et al. | 175/320 |
| 5,568,839 | 10/1996 | Campbell | 175/320 |

*Primary Examiner*—William Neuder

*Attorney, Agent, or Firm*—Burns, Doane, Swecker & Mathis, L.L.P.

[57] ABSTRACT

An extension drilling system for use with a semiautomatic drilling rig. The drilling system includes a plurality of extension rods constituting a drill rod string and having cooperating male and female threaded couplings therebetween, and being right-hand rope threaded couplings. A reversible drive chuck of a drilling rig drives (either directly, or via an adaptor), the outside of the female threaded end of an associated extension rod. A gripper grips one of the extension rods to hold the drill rod string stationary when the chuck is driven in reverse. The gripper is located such that only one threaded coupling is disposed between the chuck and grippers and to ensure that when the chuck is rotated in reverse, only the desired coupling is uncoupled. The drill rods have axial passages therethrough in communication with each other and through which flushing fluid is delivered to an associated drill bit and a non-return valve is incorporated in the passage through at least one of the drill rods. A socket of the drive chuck (or adaptor) is configured to automatically lock the drill rod in the socket in response to rotation of the drive chuck.

12 Claims, 2 Drawing Sheets

EXTENSION DRILLING SYSTEM

BACKGROUND OF THE INVENTION

1. Technical Field of the Invention

This invention relates to an extension drilling system, and more particularly, but not exclusively, to extension drilling systems for use on a semi-automatic drilling rig and used to drill holes (bores) in subterranium mining operations such as coal mining where the structure of the roof of a tunnel is to be rendered more secure by the insertion of rock bolts into holes drilled into the roof structure.

2. Description of the Prior Art

In the past, extension drilling in coal mines was carried out using square threaded rods, such as XRT-Rods with a 4TPI Acme thread. We have experimented with the use of right-hand rope threaded drill rods because of their easier uncoupling and with a male thread less prone to damage. Although various extension drilling systems had been developed based on the experimental work, we have found that they did not work with semi-automatic drilling rigs.

The primary problem with conventional drill rods for extension drilling systems, when used with semiautomatic drill rigs is that, when the drill string (a series of drill rods coupled together) are to be uncoupled there are two threaded couplings between the grippers and the chuck. As the grippers are operated, and the chuck spun slowly in reverse, the threaded joint between the drive adaptor and the bottom extension rod can become uncoupled which is undesirable as distinct from the desired uncoupling between the bottom and second bottom extension rods.

A secondary problem is that the use of a drive adaptor takes up valuable boom height on the rig thus reducing the length of the extension rods that can be used.

It is therefore an object of the present invention to overcome, or at least minimize, the above problems with known extension drilling systems when associated with semi-automatic drilling rigs.

SUMMARY OF THE INVENTION

The invention therefore envisages an extension drilling system for use with a semi-automatic drilling rig, said drilling system including a plurality of extension rods constituting a drill rod string and each having cooperating male and female threaded couplings therebetween, said couplings being right-hand rope threaded couplings and wherein, in use, a chuck of a drilling rig drives either directly, or via an adaptor, the outside of the female threaded end of an associated extension rod, whereby to result in only one threaded coupling between the chuck and a set of grippers and to ensure that when the grippers are moved to a clamping position, and the chuck is rotated in reverse, only the desired coupling is uncoupled.

Preferably the drill rods have axial passages therethrough in communication with each other and through which flushing fluid is delivered to an associated drill bit. Preferably a non-return valve is incorporated in at least one of the drill rods to shorten the delay time in delivering flushing fluid to the drill bit before recommencement of drilling after a drill rod is added to the drill rod string.

Preferably the drill rods are of hexagonal cross-section or any other suitable cross-section and may be forged or welded rods which are selectively or fully heat treated.

The invention also envisages an extension drill rod for use in the extension drilling system defined above.

BRIEF DESCRIPTION OF THE DRAWINGS

Two preferred embodiments of the invention will now be described with reference to the accompanying drawings, in which.

DESCRIPTION OF THE PREFERRED EMBODIMENTS OF THE INVENTION

Figure 1:
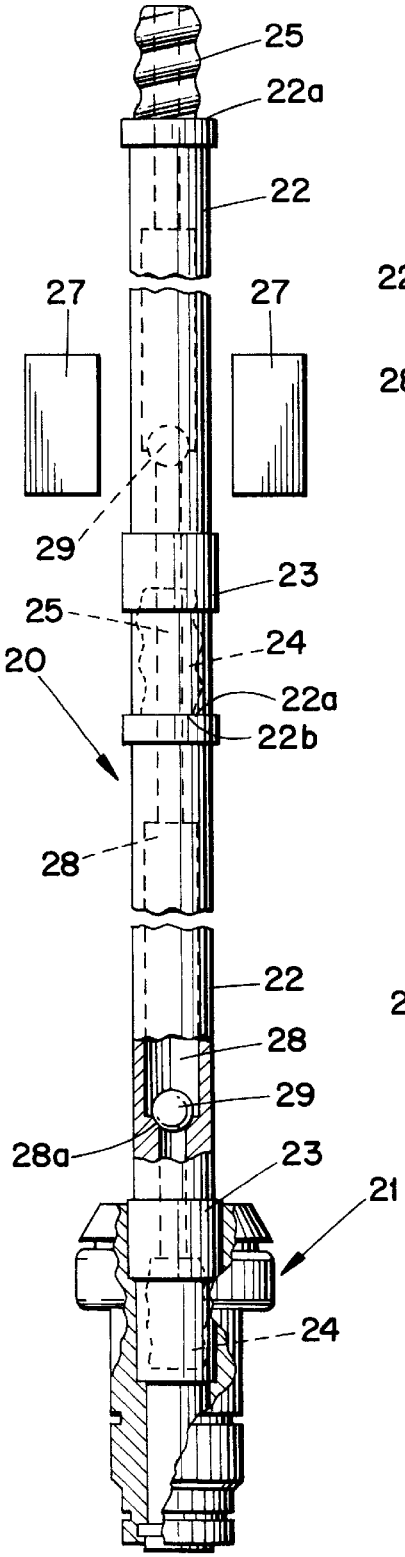
FIG. 1 is a longitudinal side elevational view of an extension drilling system in accordance with a first preferred embodiment of the invention.
Figure 2:
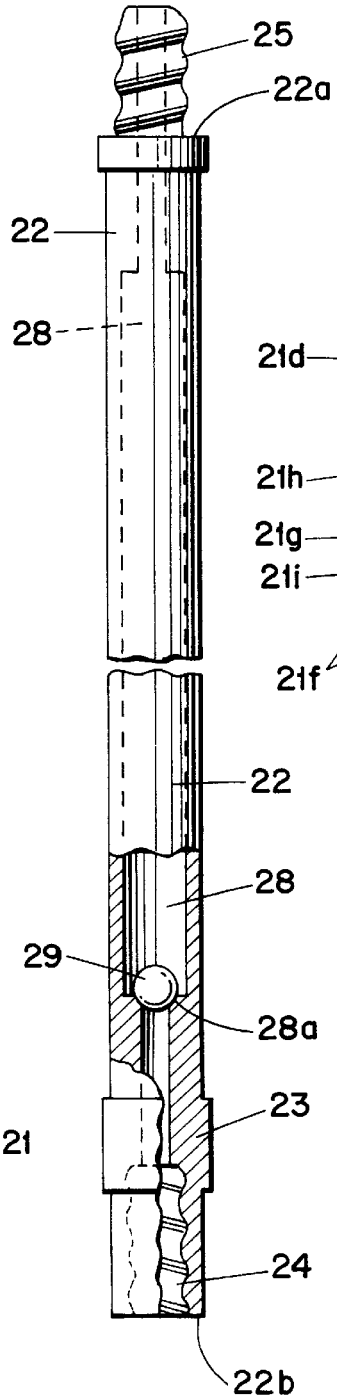
FIG. 2 is a longitudinal side elevational view of an extension rod as used in the system of FIG. 1.

With reference to FIGS. 1 and 2, the extension drilling system of this first preferred embodiment of the invention, and generally indicated as 20, utilizes a drive chuck 21 mounted on a mining/roof bolter (not shown) having a pair of clamping grippers 27. The drive chuck may be a TL2 drive chuck as manufactured by McSweeney's, Inc of the USA, and the drive chuck directly rotatable drives a string of extension rods 22, (see also FIG. 2), coupled together by one or more couplings 23 comprising cooperating righthand rope threaded female sockets 24 in one end of the respective rods, and right-hand rope threaded male members 25 carried by the other end of the respective rods. The ends of the drill rods when coupled together abut each other via shoulders 22*a* surrounding the male member 25 and bearing on end faces 22*b* surrounding the entrance to the sockets 24. The male member 25 on the outer end of the outermost rod is coupled to a drill bit, (not shown in FIGS. 1 and 2).

Axial passages 28 are provided through the respective drill rods, and in communication with each, and through which flushing fluid can be delivered to the associated drill bit. In this preferred embodiment the passages 28 through each of the drill rods are stepped at 28*a* to provide a transition between larger and smaller diameter portions of the passage whereby to provide valve seats forming part of the ball valve mechanisms, with the remainder of the mechanisms being made up of stainless steel or glass balls 29 which selectively seat on, or unseat from, the valve seat 28*a*. When seated on the valve seat, the ball 29 maintains flushing fluid in the respective drill rod in order to shorten the delay time in delivering flushing fluid to the drill bit before the re-commencement of drilling after a drill rod has been added to the drill string.

Figure 3:
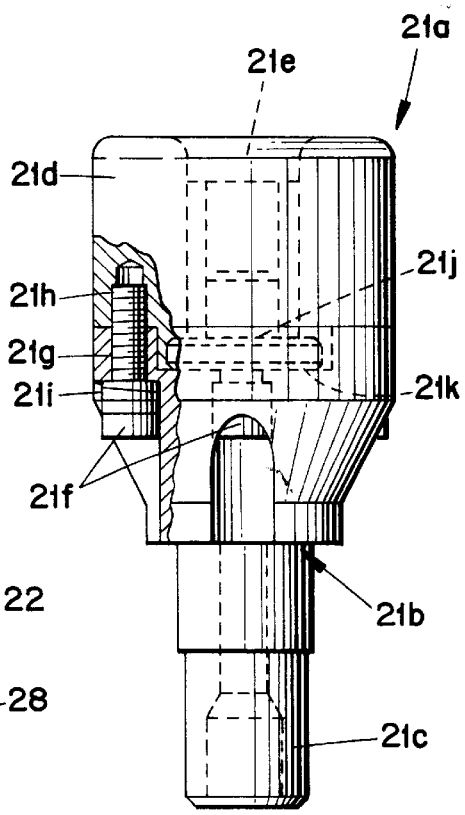
FIG. 3 is a longitudinal side elevational view, partly sectioned, of an alternative direct drive chuck for use in the extension drilling system of FIGS. 4 to 5.
Figure 4:
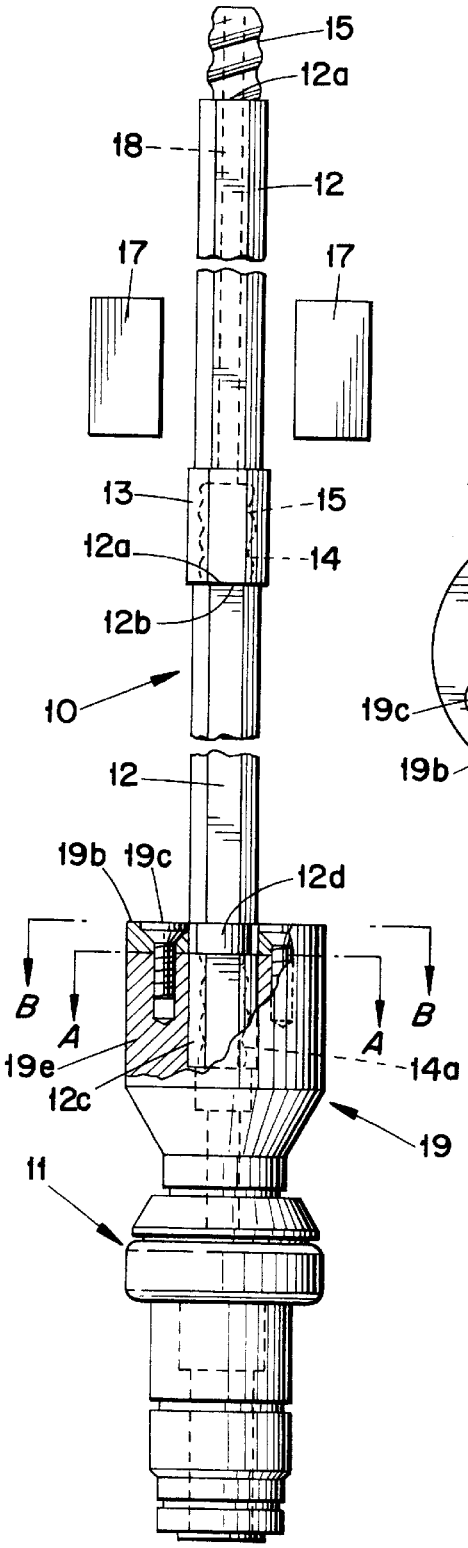
FIG. 4 is a longitudinal side elevational view, partly sectioned, of an extension drilling system in accordance with the first preferred embodiment of the invention.
Figure 5:
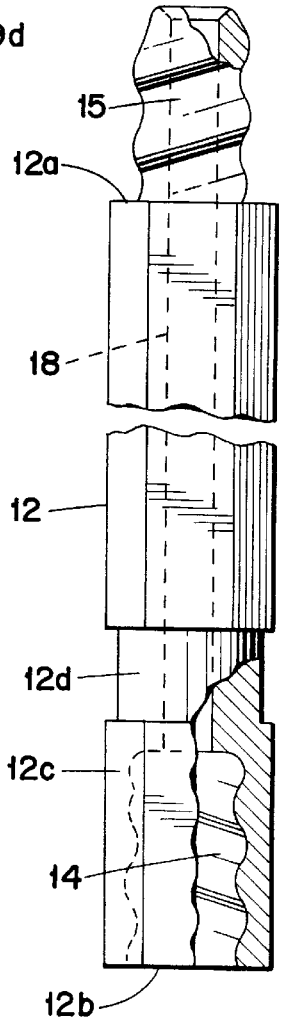
FIG. 5 is a longitudinal side elevational view of an extension drill rod as used in the system of FIG. 4.

FIG. 3 shows a modified (alternative) direct drive chuck 21*a* for use in the extension drilling systems of FIGS. 4 to 5, and is in fact the drive chuck preferred, and which is a modular assembly comprising a male drive member 21*b* having a drive shaft 21*c* and coupled to a female drive member 21*d* with a socket 21*e*. The drive members 21*b*, 21*d* are coupled by bolts 21*f* through holes 21*g* in the male drive member 21*b* and into threaded blind holes 21*h* in the female drive member 21*d* with interposed spring washers 21*i*. The male and female members may also be "dogged" together, that is, interlocked. The socket 21*e* receives a sealing member 21*j* which may be formed from polyurethane, moulded around a stainless steel washer body, and which seats on a step 21*k* in the end of the male drive member 21*b*. The modular drive chuck of this embodiment, in being formed in two separable parts, allows the drive members 21*b* and 21*d* to be interchangeable for different drive configurations, and also allows for the sealing member 21*j* to be replaced when worn.

With reference to FIG. 4, the extension drilling system of the second preferred embodiment of the invention, and generally indicated as 10, utilizes a drive chuck 11 mounted an a mining/roof bolter (not shown). The drive chuck may be a TL2 drive chuck as manufacturer by McSweeney's Inc of the USA.

In accordance with this preferred embodiment of the invention, and also with reference to FIG. 5, the drive chuck 11 rotatably drives a string of extension drill rods 12, and, in this preferred embodiment via a chuck adaptor 19, with the drill rods being coupled together by one or more couplings 13 comprised of cooperating right-hand rope threaded female sockets 14 in one end of the respective rods and right-hand rope threaded male members 15 carried by the other end of the respective rods. The ends of the drill rods, when coupled, abut each other via shoulders 12*a* surrounding the male members 15 and bearing on end faces 12*b* surrounding the entrances to the sockets 14. The male member 15 on the outer end of the outermost rod is coupled to a drill bit (not shown in FIGS. 4 and 5).

A pair of clamping grippers 17 carried by the mining/roofing bolter serves to grip the drill string during coupling and uncoupling of the drill rod. Axial passages 18 are also provided through the respective drill rods and in communication with each other and through which flushing fluid can be delivered to the associated drill bit.

Figure 4A:
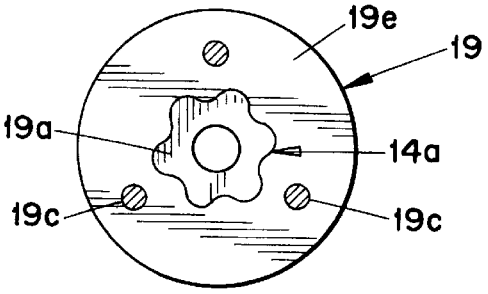
FIG. 4A is a cross-sectional view taken along line A—A of FIG. 4.
Figure 4B:
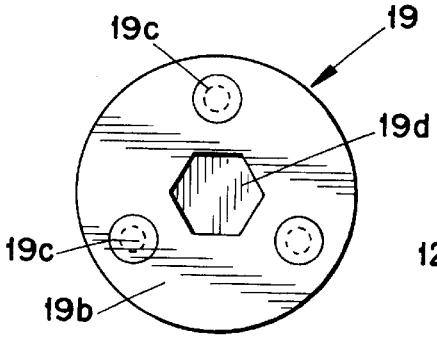
FIG. 4B is a cross-sectional view taken along line B—B of FIG. 4.

With reference to FIGS. 4 and 5, the chuck adaptor 19 includes a body 19*e* which as shown in FIG. 4A has a socket 14*a* shaped as a hexagon 19*a*. A chuck adaptor cover 19*b* as shown in FIG. 4B is bolted to the body 19*e* by bolts 19*c*. The cover provides a hole 19*d* or entry aperture for the drill rod to fit into and which has a normal hexagonal shape that is offset (turned) by 20° of rotation relative to the hexagon 19*a*. The end of the drill rod which fits into the chuck adaptor 19 has a hexagonal exterior 12*c* and above that a round section 12*d*. When the drill rod end is fitted into the chuck adaptor, the hexagon 12*c* on the end of the rod is aligned with the hexagonal hole 19*d* in the chuck adaptor cover 19*b*. The rod is then slid down into the chuck adaptor to its full extent, whereby the round section 12*d* enters the hole 19*d*. Then, as positive rotation is commenced, the chuck adaptor, due to the above-described offset, rotates 20° in relation to the rod before the drive flats of the hexagonal 19*a* in the chuck adaptor engage against the hexagonal shaped end 12*c* on the rod to thus rotatably drive the rod. The round section 12*d* on the rod permits the hexagon 19*d* to rotate relative to the rod. Thus, the hexagon 19*d* becomes misaligned with respect to the hexagon 12*c* of the drill rod. As long as positive rotation is maintained in the chuck adaptor the rod cannot be removed, since the two hexagons 12*c*, 19*d* are misaligned by 20° and the rod thus needs to be rotated by 20° relative to the cover to enable the corners of the hexagon 12*c* to clear the hexagonal hole 19*d* through the chuck adaptor cover 19*b* in order for the rod to be removed. The drive chuck as described above, in providing a twist locking action between the chuck and the rod, improves the safety of the drilling system because of the locking of the rod in the drive chuck whilst maintaining positive rotation.

In the case of both embodiments of the invention, the drill rods are of hexagonal cross-section, as previously described with reference to the embodiment of FIGS. 4 to 5, or of round cross-section or of any other suitable cross-sectional shape whereby they can be driven by the chuck adaptor 19 in the case of the embodiment of FIGS. 4 to 5 or directly by the drive chuck 21 or 21*a* in the embodiment of FIGS. 1, 2 and 3. The drill rods may be forged or welded rods which are selectively or fully heat treated.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A drilling apparatus comprising:

a plurality of extension rods constituting a drill rod string and each having cooperating male/female threaded couplings therebetween, said couplings being right-hand rope threaded couplings;

a drill bit mounted on the drill rod string;

a reversible drive mechanism for driving an outside surface of a female threaded end of an initial one of the extension rods selectively in forward and reverse directions; and a gripping mechanism for gripping one of the extension rods at a location whereby only one of the male/female couplings is disposed between the gripper and the drive mechanism to ensure that only the one male/female coupling is uncoupled when the drive mechanism is rotated in reverse.

2. An apparatus as claimed in claim 2, wherein the drill rods have axial passages therethrough in communication with each other for delivering flushing fluid to an associated drill bit.

3. An apparatus claimed in claim 2, wherein the axial passage through at least one of the drill rods incorporates a non-return valve for retaining flushing fluid to shorten a delay time in delivering flushing fluid to the drill bit before recommencement of drilling after a drill rod is added to the drill rod string.

4. An apparatus as claimed in claim 1 wherein the outside surface of the female threaded end is of non-circular cross section.

5. An apparatus as claimed in claim 4 wherein the non-circular cross section is hexagonal.

6. An apparatus as claimed in claim 4 wherein the drive mechanism includes a drive chuck having a socket, the outside surface of the female threaded end of the intial extension rod received in the socket to be directly driven by the drive chuck.

7. An apparatus as claimed in claim 4 wherein the drive mechanism includes a drive chuck having a first socket; and an adapter having a portion mounted in the first socket to be directly driven by the drive chuck, and a second socket; the outside surface of the female threaded end of the initial extension rod received in the second socket to be driven by the adapter.

8. An apparatus as claimed in claim 4, wherein the drive mechanism includes a rotatably driven socket of non-circular cross section for receiving the outside surface of the female threaded end of the initial extension rod, and an entry aperture disposed in front of the socket and rotatable therewith, the entry aperture being of non-circular cross section generally corresponding to that of the outside surface to permit the outside surface to pass completely therethrough and into the socket, the socket cross section being larger than that of the outside surface to permit the socket and entry aperture to rotate relative to the outside surface by a limited amount before the socket comes into driving relationship with the outside surface, whereby the entry aperture rotates relative to the outside surface to become misaligned therewith to prevent accidental removal of the initial extension rod from the socket.

9. An apparatus as claimed in claim 8 wherein the entry aperture is of generally similar cross sectional shape as the socket and is rotationally offset relative thereto.

10. An apparatus as claimed in claim 9 wherein the cross sections of the outside surface, the entry aperture, and the socket are hexagonal.

11. A mine roof drilling apparatus comprising:

a plurality of vertically extending extension rods constituting a drill rod string, each extension rod including an upper end comprising a male right-hand rope thread, and a lower end comprising a socket having internal and external surfaces, the internal surface being a female right-hand rope thread adapted to be connected to a male rope thread of another extension rod, whereby adjacent ones of the extension rods are interconnected by a male/female threaded coupling, the external surface being of non-circular cross sectional shape;

a drill bit mounted at an upper end of the drill string; and a drive chuck having a drive socket for driving the drill string, the drive socket having an internal surface configured complementarily to the external surface of the socket;

the socket of a lowermost one of the extension rods being received in the drive socket whereby drive forces are transmitted from the internal surface of the drive socket to the external surface of the socket of the lowermost extension rod independently of the female rope thread of the socket.

12. A drilling apparatus according to claim 11 wherein the drill bit includes a through-passage for guiding flushing fluid to an upper end thereof; each of the extension rods including a through-passage for guiding flushing fluid to the through-passage of the drill bit, an upwardly facing valve seat facing away from the drive chuck, and a valve element movable upwardly away from the valve seat under the force of upwardly flowing flushing fluid; the valve element lying against the valve seat during a stoppage of flushing fluid flow for retaining flushing fluid thereabove and thereby shorten a time delay in delivering flushing fluid to the drill bit before a recommencement of drilling after an extension rod is added to the drill string.

* * * * *